US006830482B2

(12) United States Patent
Matsumura et al.

(10) Patent No.: US 6,830,482 B2
(45) Date of Patent: Dec. 14, 2004

(54) FUSIBLE LINK AND METHOD OF PRODUCING SAID FUSIBLE LINK

(75) Inventors: Norio Matsumura, Shizuoka (JP); Shinya Onoda, Shizuoka (JP); Yusuke Matsumoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/725,435

(22) Filed: Dec. 3, 2003

(65) Prior Publication Data

US 2004/0137792 A1 Jul. 15, 2004

(30) Foreign Application Priority Data

Dec. 4, 2002 (JP) ..... P2002-352130

(51) Int. Cl.[7] ..... H01R 13/68
(52) U.S. Cl. ..... 439/621; 29/623
(58) Field of Search ..... 439/621, 622, 439/590, 537, 949, 76.2; 337/160, 161, 198; 29/623, 874

(56) References Cited

U.S. PATENT DOCUMENTS 5,661,448 A * 8/1997 Totsuka et al. ..... 337/160
5,668,522 A * 9/1997 Kondo et al. ..... 337/198
5,802,703 A * 9/1998 Totsuka et al. ..... 29/623
6,280,253 B1 * 8/2001 Kraus et al. ..... 439/621
6,322,376 B1 * 11/2001 Jetton ..... 439/76.2
6,622,375 B1 * 9/2003 Endo et al. ..... 29/623
6,666,723 B2 * 12/2003 Fukumori et al. ..... 439/621
6,759,938 B2 * 7/2004 Matsumura et al. ..... 337/161

FOREIGN PATENT DOCUMENTS

JP 2000-133114 5/2000

* cited by examiner

*Primary Examiner*—Alex Gilman
(74) *Attorney, Agent, or Firm*—Finnegan, Henderson, Farabow, Garrett & Dunner, L.L.P.

(57) ABSTRACT

In a fusible link including a plurality of fuse circuit-forming members each having a plurality of terminal portions which are arranged in a chain-like manner, and are connected to an interconnecting plate portion through respective fusible portions, and the plurality of fuse circuit-forming members are mounted on housings to form large-current fuse circuits. A bending portion is formed integrally at a generally central portion of the interconnecting plate portion, and the fuse circuit-forming members are formed integrally respectively at opposite sides of the bending portion, and the bending portion and the fuse circuit-forming members are formed by an electrically-conductive flat plate. The insulating housings are formed integrally respectively on the fuse circuit-forming members by insert molding, and the bending portion is bent at its predetermined portions in such a manner that the housings are disposed in parallel opposed relation to each other.

4 Claims, 5 Drawing Sheets

13'
15
14
15
15
15
16
16a
16
16a
16
16a

FUSIBLE LINK AND METHOD OF PRODUCING SAID FUSIBLE LINK

The present application is based on Japanese Patent Application No. 2002-352130, the entire contents of which are incorporated herein by reference.

BACKGROUND OF THE INVENTION

1. Field of the Invention

This invention relates to a chain-type fusible link for a large current including fuse circuit-forming members each having terminal portions interconnected in a chain-like manner through respective fusible portions, and also relates to a method of producing this fusible link.

2. Related Art

FIG. 5 shows one conventional fusible link of the type described. This fusible link 1 comprises first and second fuse circuit-forming members 3 and 4, and a box-shaped housing 2 (made of a synthetic resin) in which these fuse circuit-forming members 3 and 4 mounted.

The first fuse circuit-forming member 3 includes an interconnecting plate portion 3*a*, a plurality of terminal portions 3*c* and 3*c*' connected to the interconnecting plate portion 3*a* through respective fusible portions 3*b*, a battery terminal 3*d* extending from one end of the interconnecting plate portion 3*a*, and a common terminal portion 5*a* connected to the other end of the interconnecting plate portion 3*a* through a fusible portion (not shown). This first fuse circuit-forming member 3 is formed by pressing an electrically-conductive flat plate (not shown).

The second fuse circuit-forming member 4 includes an interconnecting plate portion 4*a*, a plurality of terminal portions 4*c* and 4*c*' connected to the interconnecting plate portion 4*a* through respective fusible portions 4*b*, and a common terminal portion 5*b* extending from an end of the interconnecting plate portion 4*a*. This second fuse circuit-forming member 4 is formed by pressing an electrically-conductive flat plate (not shown), separately from the first fuse circuit-forming member 3.

The housing 5 has a generally rectangular parallelepiped shape, and has a circuit member-receiving chamber 2*b* formed therein, and this chamber 2*b* has an opening 2*a* formed in an upper side of the housing. A plurality of connector housing portions 2*c* and a plurality of terminal support portions 2*d* are formed at a lower side of the circuit member-receiving chamber 2*b*. The opening 2*a* in the housing 2 is closed by a lid 6.

In the above construction, the first and second fuse circuit-forming members 3 and 4 are inserted into the circuit member-receiving chamber 2*b* through the opening 2*a* in the housing 2. When the first and second fuse circuit-forming members 3 and 4 are completely received in the circuit member-receiving chamber 2*b*, the interconnecting plate portions 3*a* and 4*a* of the first and second fuse circuit-forming members 3 and 4 are located in the circuit member-receiving chamber 2*b*, and also the terminal portions 3*c*, 3*c*', 4*c* and 4*c*' are set in their respectively predetermined positions in the connector housing portions 2*c* and terminal support portions 2*d*.

Then, the common terminal portions 5*a* and 5*b* of the first and second fuse circuit-forming members 3 and 4 are fastened to the housing by a bolt 7. As a result, the first and second fuse-forming members 3 and 4 are electrically connected together, so that desired fuse circuits are formed by the first and second fuse circuit-forming members 3 and 4.

The battery terminal 3*d* of the first fuse circuit-forming member 3 is fastened to the housing 2 by a bolt (not shown). A terminal of a battery cable (not shown) is connected to the battery terminal 3*d*, and terminals of each of mating connectors are connected respectively to the terminal portions 3*c* and 4*c* in the corresponding connector housing 2*c*, and LA terminals (not shown) are connected by screw-fastening respectively to the terminal portions 3*c*' and 4*c*' received in the terminal support portions 2*d*. The terminals of the mating connectors and the LA terminals are connected to loads via cables (not shown), and electric power is distributed and supplied from a battery to these loads via the fuse circuits.

When a current of above a predetermined value flows through any of the fusible portion 3*b*, 4*b*, for example, in the event of a short-circuiting accident on the part of the corresponding load, the fusible portion 3*b*, 4*b* is heated to be melted, thereby preventing an accident due to such excess current.

JP-A-2000-133114 shows another conventional fusible link.

In the above conventional fusible link 1, however, the flat plate-like first and second circuit-forming members 3 and 4, formed separately from each other, were mounted in the housing 2 to form a unit, and therefore the assembling operation was cumbersome, and besides the overall size was large. Particularly, it was necessary to secure a space for a mounting jig for mounting the first and second fuse circuit-forming members 3 and 4 in the circuit member-receiving chamber 2*b* in the housing 2, and therefore the compact design was limited. Furthermore, when the number of the fuse circuits was increased, the housing of a large size must be used.

SUMMARY OF THE INVENTION

This invention has been made in order to solve the above problems, and an object of the invention is to provide a fusible link, in which a sufficient number of fuse circuits can be secured, and the overall size can be made small, and also to provide a method of producing this fusible link.

(1) The invention is directed to a fusible link including a plurality of fuse circuit-forming members each having a plurality of terminal portions which are arranged in a chain-like manner, and are connected to an interconnecting plate portion through respective fusible portions, and the plurality of fuse circuit-forming members being mounted on a housing to form large-current fuse circuits; characterized in that a bending portion is formed integrally at a generally central portion of the interconnecting plate portion, and the fuse circuit-forming members are formed integrally respectively at opposite sides of the bending portion, and the bending portion and the fuse circuit-forming members are formed by an electrically-conductive flat plate; and insulating housings, forming the housing, are formed integrally respectively on the fuse circuit-forming members by insert molding; and the bending portion is bent at its predetermined portion in such a manner that the housings are disposed in parallel opposed relation to each other.

In this fusible link, the bending portion of the interconnecting plate portion is bent at its predetermined portion in such a manner that the two housings, formed integrally respectively (by insert molding) on the fuse circuit-forming members provided respectively at the opposite sides of the bending portion, are disposed in parallel opposed relation to each other. Therefore, by bending the single flat plate, the fuse circuits, generally equal in number to fuse circuits obtained with two plate plates, can be secured. And besides, it is not necessary to secure a space for a mounting jig for mounting the pair of circuit-forming members in the housing, and therefore the whole of the fusible link can be formed into a compact design.

(2) The fusible link of the invention is further characterized in that a plurality of ribs are formed integrally with and project from an outer surface of each of the housings in such a manner that the two adjacent ribs are disposed respectively at opposite sides of each of the terminal portions in opposed relation to each other.

In this fusible link, a terminal receiving portion for receiving a mating terminal for connection to the terminal portion is formed between the opposed ribs disposed respectively at the opposite sides of each terminal portion.

(3) The fusible link of the invention is further characterized in that a retaining portion is formed on one of the two housings, while an engagement portion for retaining engagement with the retaining portion to hold the housings in parallel opposed relation to each other is formed on the other housing.

In this fusible link, when the bending portion is bent, the retaining portion on the one housing is retainingly engaged with the engagement portion on the other housing, thereby positively holding the two housings in parallel opposed relation to each other.

(4) The invention is directed to a method of producing a fusible link including a plurality of fuse circuit-forming members each having a plurality of terminal portions which are arranged in a chain-like manner, and are connected to an interconnecting plate portion through respective fusible portions, the plurality of fuse circuit-forming members being mounted on a housing to form large-current fuse circuits; characterized in that a bus bar is formed by pressing a single electrically-conductive flat plate in such a manner that a bending portion is formed at a generally central portion of the flat plate while the fuse circuit-forming members are formed respectively at opposite sides of the bending portion, and subsequently insulating housings, forming the housing, are formed integrally respectively on the fuse circuit-forming members, provided respectively at the opposite sides of the bending portion of the bus bar, by insert molding; and subsequently the bending portion of the bus bar is bent at its predetermined portion in such a manner that the housings are disposed in parallel opposed relation to each other while a retaining portion of one of the two housings is retainingly engaged with an engagement portion of the other housing, thereby assembling and producing the fusible link.

In this fusible link-producing method, the fusible links can be mass-produced at low costs merely by effecting the simple operation in which the bending portion of the bus bar is bent at its predetermined portion in such a manner that the two housings, provided respectively at the opposite sides of the bending portion, are disposed in parallel opposed relation to each other.

DETAILED DESCRIPTION OF THE PREFERRED EMBODIMENTS

One preferred embodiment of the present invention will now be described with reference to the drawings.

Figure 1:
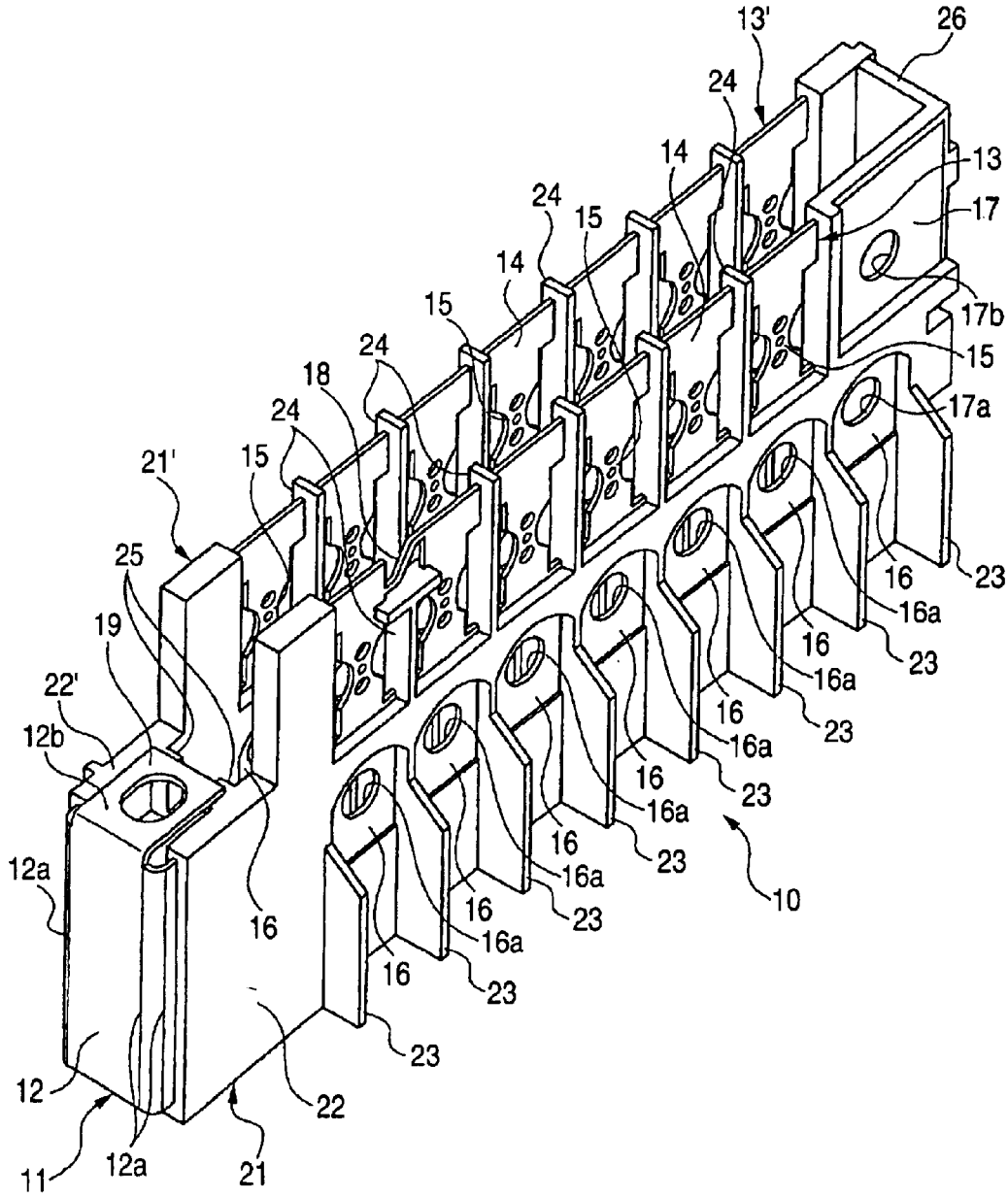
FIG. 1 is a perspective view showing one preferred embodiment of a fusible link of the invention.
Figure 2:
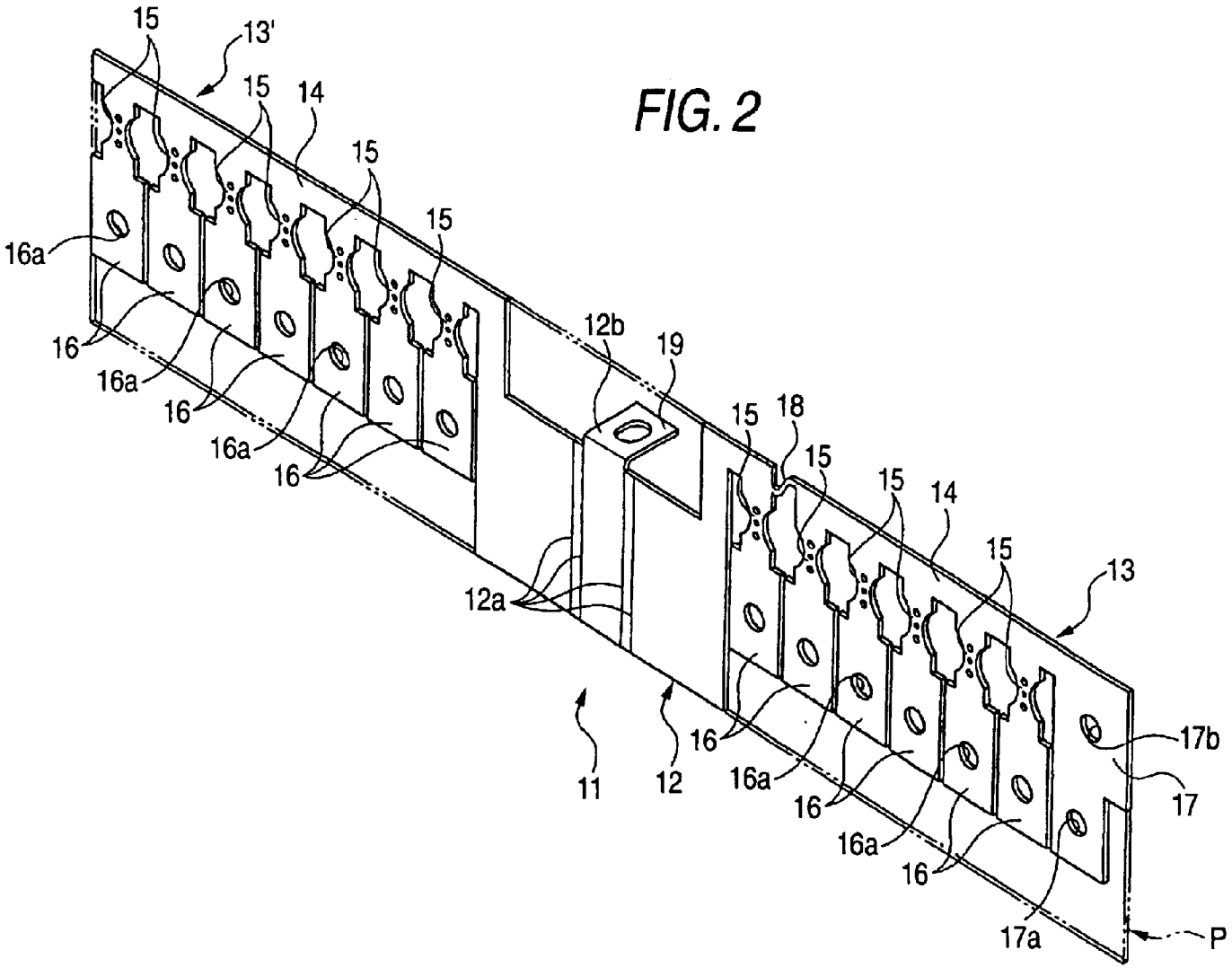
FIG. 2 is a perspective view of a bus bar used in the fusible link, showing a condition before the bus bar is bent.
Figure 3:
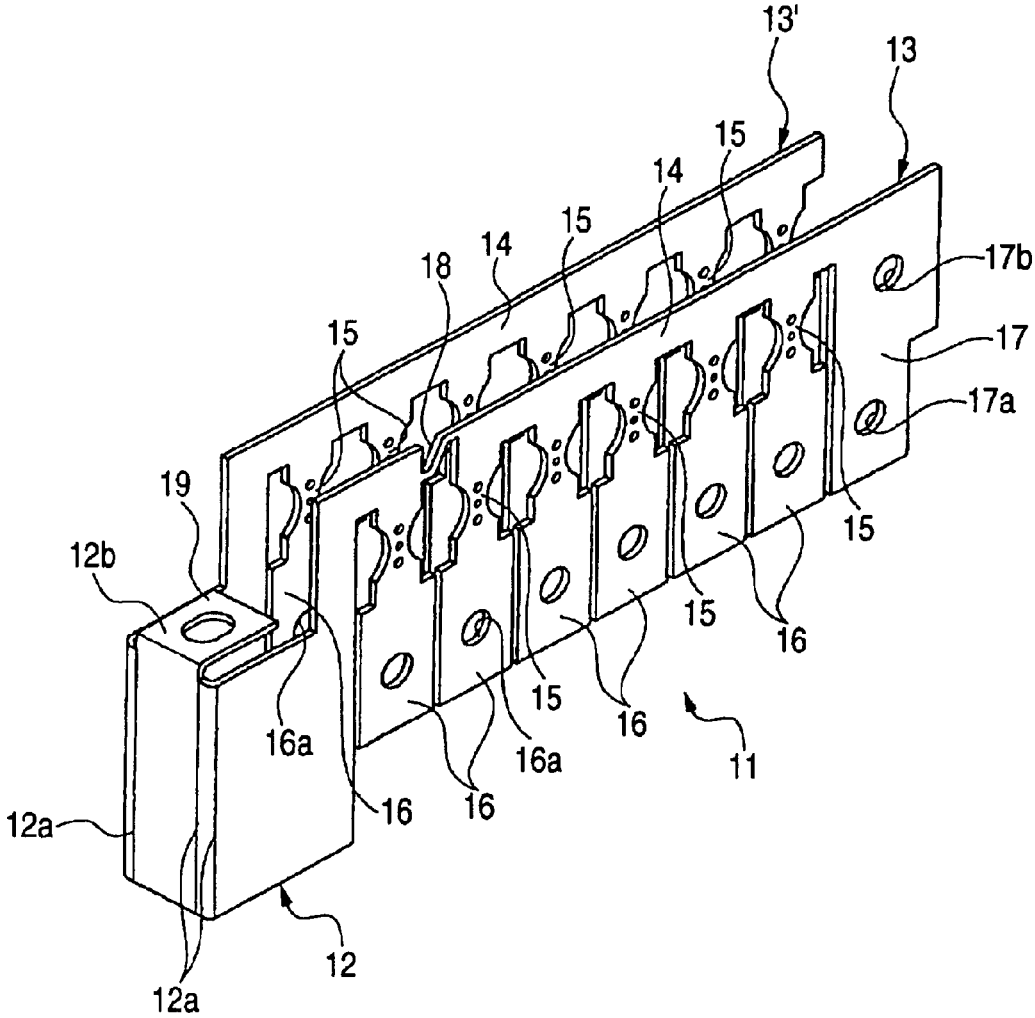
FIG. 3 is a perspective view of the bus bar, showing a condition after the bus bar is bent.
Figure 4:
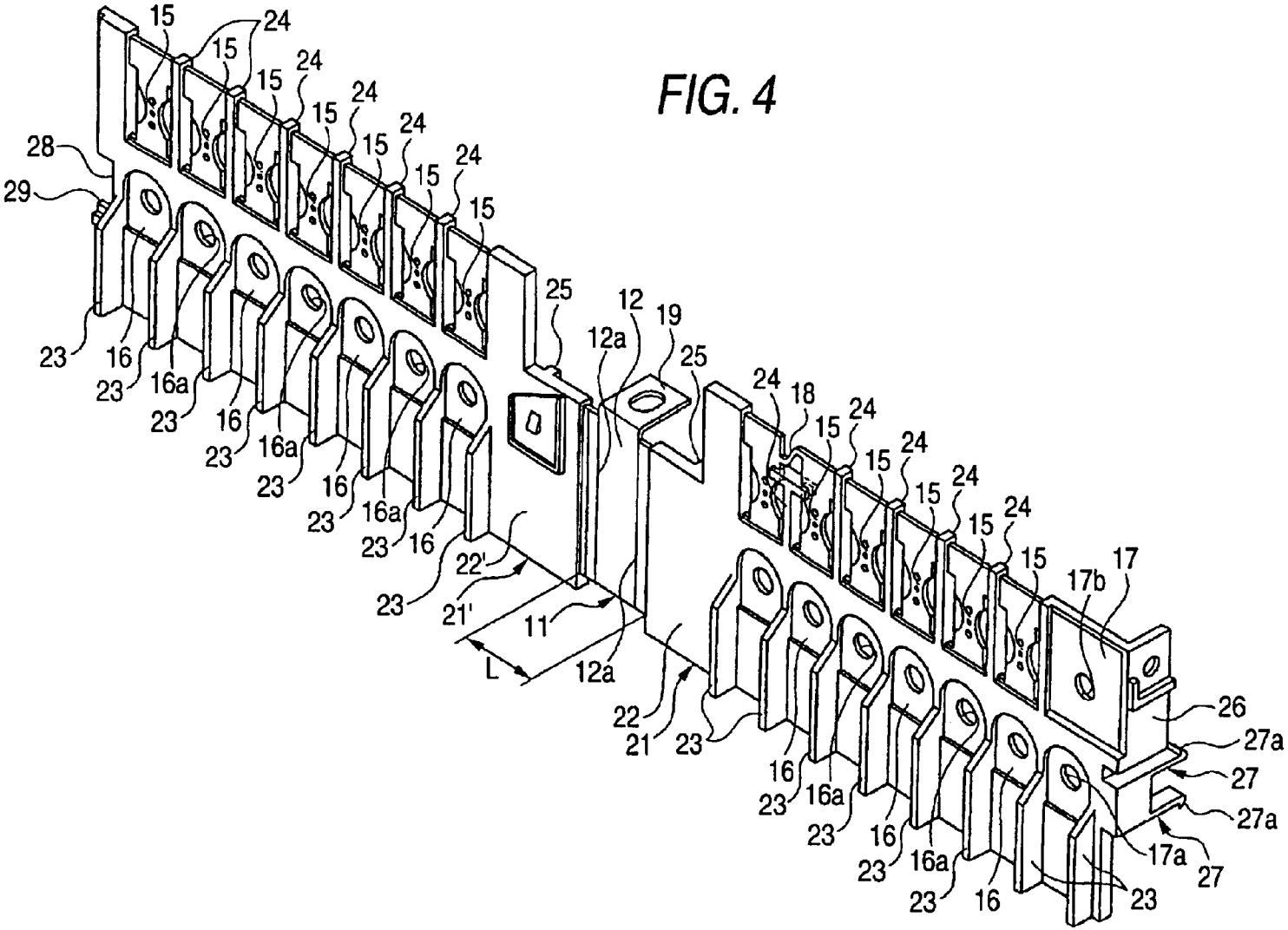
FIG. 4 is a perspective view showing a condition in which housings are formed integrally respectively on opposite side portions of the bus bar (which is not yet bent) by insert molding.
Figure 5:
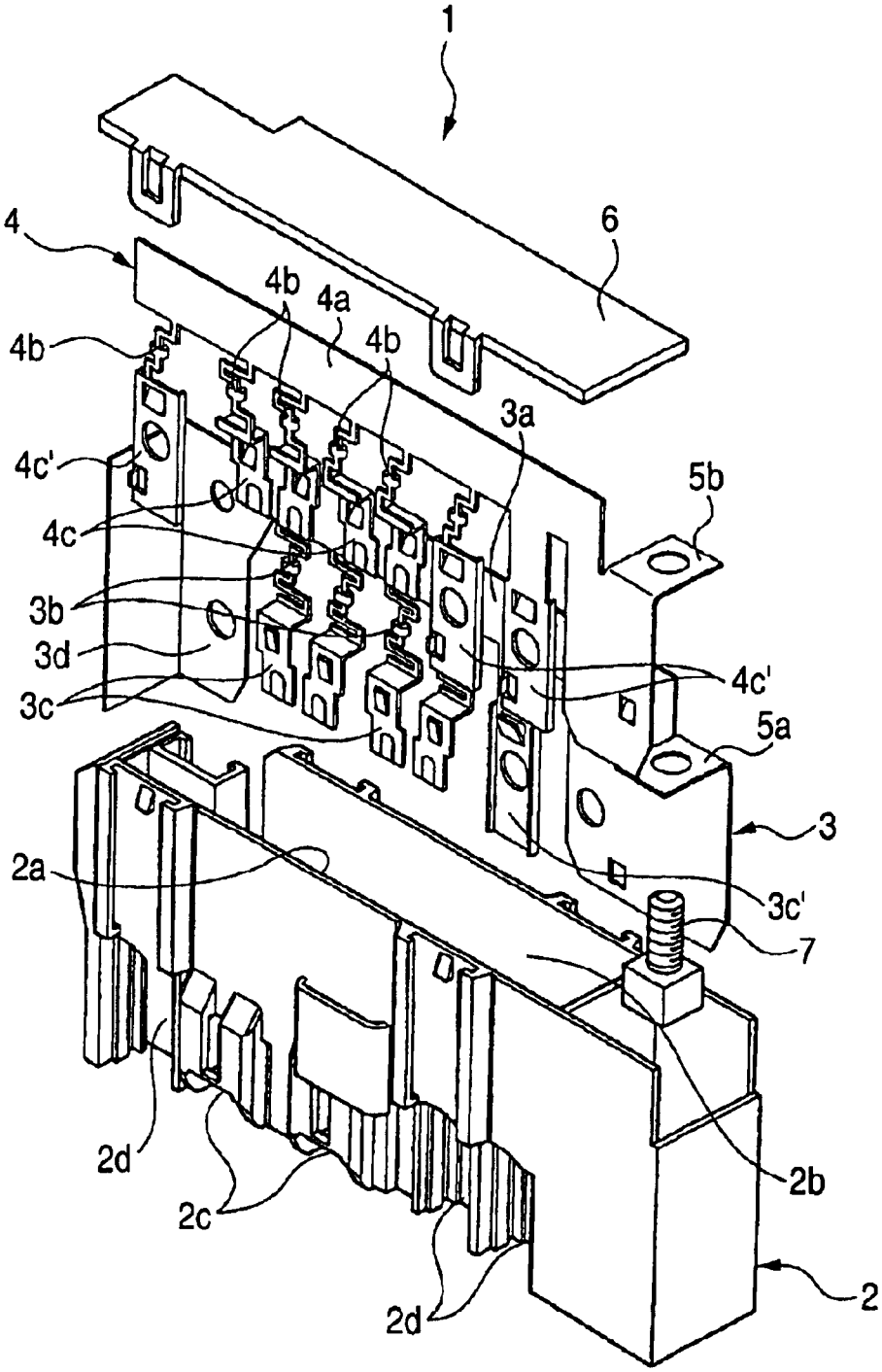
FIG. 5 is a perspective view of a conventional fusible link.

FIG. 1 is a perspective view showing one preferred embodiment of a fusible link of the invention, FIG. 2 is a perspective view of a bus bar used in the fusible link, showing a condition before the bus bar is bent, FIG. 3 is a perspective view of the bus bar, showing a condition after the bus bar is bent, and FIG. 4 is a perspective view showing a condition in which housings are formed integrally respectively with opposite side portions of the bus bar (which is not yet bent) by insert molding.

As shown in FIGS. 1 and 4, the fusible link 10 comprises the flat plate-like bus bar 11 of an electrically-conductive nature, and the pair of insulating housings 21 and 21'. The bus bar 11 has fuse circuit-forming members 13 and 13' (which form large-current fuse circuits) integrally formed respectively at opposite sides of a bending portion 12 formed generally at a central portion of the bus bar 11. The housings 21 and 21' are formed integrally respectively one the pair of fuse circuit-forming members 13 and 13' by insert molding a synthetic resin. The bending portion 12 is bent in such a manner that the pair of housings 21 and 21' are disposed in parallel opposed relation to each other, thereby forming the fusible link 10.

As shown in FIG. 2, the bending portion 12 of the bus bar 11 is formed integrally at a generally central portion of an interconnecting plate portion 14 of the pair of fuse circuit-forming members 13 and 13'. By pressing a single flat plate P of an electrically-conductive nature, the pair of fuse circuit-forming members 13 and 13' are integrally formed respectively at the opposite sides of the bending portion 12. Namely, by pressing this plate P, there is formed the bus bar 11 having the pair of fuse circuit-forming members 13 and 13' provided respectively at the opposite sides of the bending portion 12. Two pairs of grooves 12*a* are formed at a generally central portion of the bending portion 12 by pressing, and extend in an upward-downward direction, the two pair of grooves 12*a* being spaced a predetermined distance from each other. The bending portion 12 can be easily bent inwardly along the pairs of grooves 12*a*. An extension portion 12*b* of a rectangular shape is integrally formed with and projects from an upper edge of the central portion of the bending portion 12, and this extension portion 12*b* is bent inwardly at right angles to form an alternator terminal portion 19.

As shown in FIGS. 2 and 3, the fuse circuit-forming member 13 includes the elongate and narrow interconnecting plate portion 14 of a rectangular shape extending from one side edge of the bending portion 12 at an upper end portion thereof, a plurality of screw-fastening terminal portions 16 which are connected to this interconnecting plate portion 14 in a chain-like manner through respective fusible portions 15, and extend in a transverse direction, one battery terminal portion 17 which is connected directly (that is, not through a fusible portion) to one end of the interconnecting plate portion 14 remote from the bending portion 12, and extends in the transverse direction, and a fusible portion 18 (for an alternator circuit) which is formed at the other end portion of the interconnecting plate portion 14, and extends in the longitudinal direction. The fusible portions 15, as well as the fusible portion 18, are narrow, and when an electric current of above a predetermined value flows through the fusible portions 15 and 18, the fusible portions melts. The plurality of screw-fastening terminal portions 16 and the battery terminal portion 17 are arranged in such a chain-like manner that any two adjacent terminal portions are spaced a predetermined distance from each other.

The other fuse circuit-forming member 13' includes the elongate and narrow interconnecting plate portion 14 of a rectangular shape extending from the other side edge of the bending portion 12 at the upper end portion thereof, and a plurality of screw-fastening terminal portions 16 which are connected to this interconnecting plate portion 14 in a chain-like manner through respective fusible portions 15. Each of these fusible portions 15 are narrow, and when an electric current of above a predetermined value flows through these fusible portions 15, the fusible portions 15 melt. The plurality of screw-fastening terminal portions 16 are arranged in such a chain-like manner that any two adjacent terminal portions are spaced a predetermined distance from each other.

As shown in FIGS. 1 and 4, the housing 21 is formed integrally on the fuse circuit-forming member 13 by insert molding, and this housing 21 includes a housing body 22 which covers generally the whole of the fuse circuit-forming member 13 (at a region extending from the right-hand grooves 12*a* (in the drawings) to the distal end of the fuse circuit-forming member 13) except the fusible portions 15 and those portions of the terminal portions 16 and 17 disposed respectively around screw-fastening holes 16*a*, 17*a* and 17*b* thereof. A plurality of ribs 23 of a generally trapezoidal shape are formed integrally with and project from an outer surface of the housing body 22 in such a manner that the two adjacent ribs 23 and 23 are disposed respectively at opposite sides of each of the terminal portions 16 and 17 in opposed relation to each other. A space, formed between the adjacent ribs 23 and 23 disposed respectively at the opposite sides of each of the terminal portions 16 and 17, forms a terminal receiving portion for receiving a corresponding mating terminal. The housing body 22 also has a plurality of ribs 24 formed integrally therewith and projecting from the outer and inner surfaces thereof, the two adjacent ribs 24 and 24 being disposed respectively at opposite sides of each of the fusible portions 15.

A rib 25 is formed integrally on the inner surface (reverse surface) of the housing body 22, and is disposed outwardly of the pair of grooves 12*a* in the bending portion 12, and when the bending portion 12 is bent inwardly, the alternator terminal portion 19 rests on the rib 25. A projecting portion 26 is formed on and projects perpendicularly from the reverse surface of the housing body 22 at the distal end thereof disposed at the battery terminal portion 17. The projecting portion 26 has a width substantially equal to a width L of an exposed portion of the bending portion 12, and when the bending portion 12 is bent inwardly along the two pairs of grooves 12*a*, the two housings 21 and 21' are disposed in parallel opposed relation to each other through this projecting portion 26. A pair of elastic piece portions (retaining portions) 27 and 27 are formed integrally with and project from a lower end portion of the projecting portion 26.

As shown in FIGS. 1 and 4, the other housing 21' is formed integrally with the other fuse circuit-forming member 13' by insert molding, and this housing 21' includes a housing body 22' which covers generally the whole of the fuse circuit-forming member 13' (at a region extending from the left-hand grooves 12*a* (in the drawings) to the distal end of the fuse circuit-forming member 13') except the fusible portions 15 and those portions of the terminal portions 16 disposed respectively around screw-fastening holes 16*a* thereof. A plurality of ribs 23 of a generally trapezoidal shape are formed integrally with and project from an outer surface of the housing body 22' in such a manner that the two adjacent ribs 23 and 23 are disposed respectively at opposite sides of each of the terminal portions 16 in opposed relation to each other. A space, formed between the adjacent ribs 23 and 23 disposed respectively at the opposite sides of each of the terminal portions 16, forms a terminal receiving portion for receiving a corresponding mating terminal. The housing body 22' also has a plurality of ribs 24 formed integrally therewith and projecting from the outer and inner surfaces thereof, the two adjacent ribs 24 and 24 being disposed respectively at opposite sides of each of the fusible portions 15.

A rib 25 is formed integrally on the inner surface (reverse surface) of the housing body 22', and is disposed outwardly of the pair of grooves 12*a* in the bending portion 12, and when the bending portion 12 is bent inwardly, the alternator terminal portion 19 rests on the rib 25. A recess 28 for receiving distal ends of the pair of elastic piece portions 27 and 27 of the housing 21 is formed in that portion of the housing 22' which is to be opposed to the pair of elastic piece portions 27 and 27. A pair of engagement projections (engagement portions) 29 and 29 are formed integrally on upper and lower surfaces of the recess 28, respectively, and hooks 27*a* and 27*a*, formed respectively at the distal ends of the pair of elastic piece portions 27 and 27, can be brought into and out of retaining engagement with the pair of engagement projections 29 and 29, respectively. When the bend portion 12 of the bus bar 11 is bent inwardly along the two pairs of grooves 12*a* and 12*a*, the two housings 21 and 21' are held in parallel opposed relation to each other by retainingly engaging the pair of elastic piece portions 27 and 27 respectively with the pair of engagement projections 29 and 29.

The upper sides of the housings 21 and 21', disposed in parallel opposed relation to each other, are covered with a cover (not shown) made of a synthetic resin.

When the fusible link 10 of this embodiment is to be produced, first, the single flat metal plate P is pressed, thereby forming the bus bar 11 which includes the bending portion 12 formed generally at the central portion thereof, and the pair of fuse circuit-forming members 13 and 13' provided respectively at the opposite sides of the bending portion 12, as shown in FIG. 2.

Then, the housings 21 and 21' are formed integrally respectively on the fuse circuit-forming members 13 and 13' (formed respectively at the opposite sides of the bending portion 12 of the bus bar 11) by insert molding the synthetic resin as shown in FIG. 4. Then, the bending portion 12 of the bus bar 11 is bent inwardly at the two pairs of grooves 12*a*, so that the two housings 21 and 21' are disposed in parallel relation to each other, and the hooks 27*a* and 27*a*, formed respectively at the distal ends of the pair of elastic piece portions 27 and 27 on the one housing 21, are retainingly engaged respectively with the pair of engagement projections 29 and 29 formed on the other housing 21', thereby producing the fusible link 10 as shown in FIG. 1.

LA (round) terminals (not shown) of a battery cable are connected to the exposed battery terminal portion 17, exposed from the one housing 21, by bolts and nuts, and terminals (not shown) of an alternator cable (not shown) are connected to the alternator terminal portion 19 by bolts and nuts. LA terminals (not shown), serving as mating terminals, are connected respectively to the exposed screw-fastening terminal portions 16 of each of the housings 21 and 21' by nuts and screws. These LA terminals are connected to various loads (not shown) via cables.

Electric power is distributed and supplied from the battery and the alternator to these loads via the fuse circuits formed by the fuse circuit-forming members 13 and 13' of the fusible link 10. When electric power in the battery is decreased, electric power is supplied from the alternator to the battery, thereby charging the battery. When a current of above a predetermined value flows through any of the fusible portion 15 and 18, for example, in the event of a short-circuiting accident on the part of the corresponding load, this fusible portion 15, 18 is heated to be melted, thereby preventing an accident due to such excess current.

Thus, the fusible link 10 can be assembled and produced merely by effecting the simple operation in which the bending portion 12 is bent at the grooves 12*a* in such a manner that the two housings 21 and 21', provided respectively at the opposite sides of the bending portion 12, are disposed in parallel relation to each other. Therefore, the compact fusible links 10 can be mass-produced at low costs.

The resin-molded housings 21 and 21' are formed integrally respectively on the fuse circuit-forming members 13 and 13' provided respectively at the opposite sides of the bending portion 12 of the bus bar 11, and it is not necessary to secure a space for a mounting jig for mounting the separate fuse circuit-forming members in the housing as in the conventional construction, and therefore the fusible link 10 can be formed into a more compact design, and besides the fuse circuits, generally equal in number to fuse circuits obtained with two bus bars, can be obtained with the single bus bar 11. Therefore, a compact and space-saving layout for the increased number of circuits can be achieved, and also the output portions can be set into an efficient connection form (existing connection form).

The plurality of ribs 23 are formed integrally with and project from the outer surface of the housing 21, 21' in such a manner that the two adjacent ribs 23 and 23 are disposed respectively at the opposite sides of each of the terminal portions 16 and 17 in opposed relation to each other, and therefore the terminal receiving portion for receiving the corresponding mating terminal is provided between any two adjacent opposed ribs 23 and 23 formed respectively at the opposite sides of the terminal portion 16, 17, and each LA terminal, connected to the terminal portion 16, 17, is positively received between the corresponding ribs 23 and 23, and is protected by these ribs 23 and 23.

The pair of elastic piece portions 27 and 27 are formed integrally on the one housing 21, while the pair of engagement projections 29 and 29 for retaining engagement with the hooks 27*a* and 27*a* (formed respectively at the distal ends of the pair of elastic piece portions 27 and 27) to hold the pair of housings 21 and 21' in parallel opposed relation to each other are formed integrally on the other housing 21'. Therefore, when the bending portion 12 of the bus bar 11 is bent, the two housings 21 and 21' are positively held in parallel opposed relation to each other by retainingly engaging the hooks 27*a* of the pair of elastic piece portions 27 (formed on the one housing 21) respectively with the engagement projections 29 formed on the other housing 21'.

In the above embodiment, although the fuse circuit-forming members are arranged in two layers in parallel relation through the single bending portion, fuse circuit-forming members can be arranged in three or more layers in parallel relation through two or more bending portions.

As described above, in the fusible link of the invention, the bending portion is formed integrally at the generally central portion of the interconnecting plate portion, and the fuse circuit-forming members are formed integrally respectively at the opposite sides of the bending portion, and the bending portion and the fuse circuit-forming members are formed by the electrically-conductive flat plate, and the insulating housings are formed integrally respectively on the fuse circuit-forming members by insert molding, and the bending portion is bent at its predetermined portion in such a manner that the housings are disposed in parallel opposed relation to each other. Therefore, a sufficient number of fuse circuits can be secured, and besides the whole of the fusible link can be formed into a compact design.

In the fusible link of the invention, the plurality of ribs are formed integrally with and project from the outer surface of each of the housings in such a manner that the two adjacent ribs are disposed respectively at the opposite sides of each of the terminal portions in opposed relation to each other. Therefore, the terminal receiving portion for receiving the mating terminal for connection to the terminal portion is formed between the opposed ribs disposed respectively at the opposite sides of each terminal portion.

In the fusible link of the invention, the retaining portion is formed on one of the two housings, while the engagement portion for retaining engagement with the retaining portion to hold the housings in parallel opposed relation to each other is formed on the other housing. Therefore, when the bending portion is bent, the retaining portion on the one housing is retainingly engaged with the engagement portion on the other housing, thereby positively holding the two housings in parallel opposed relation to each other.

In the fusible link-producing method of the invention, the fusible link can be produced at low costs merely by effecting the simple operation in which the bending portion of the bus bar is bent at its predetermined portion in such a manner that the two housings, provided respectively at the opposite sides of the bending portion, are disposed in parallel opposed relation to each other. Therefore, the fusible links of a compact design can be mass-produced at low costs.

What is claimed is:

1. A fusible link in which a large-current fuse circuit is formed, comprising:

a plurality of fuse circuit-forming members, each having a plurality of terminal portions which are connected to an interconnecting plate portion through respective fusible portions, and a plurality of insulating housings on which said plurality of fuse circuit-forming members are mounted respectively;

wherein a bending portion is integrally formed between adjacent fuse circuit-forming members of said plurality of fuse circuit-forming members, said bending portion and said adjacent fuse circuit-forming members are formed in a conductive flat plate, said housings are integrated with said circuit forming members by insert-molding, and said bending portion is bent at a predetermined portion therein so that said housings are opposed in parallel with each other.

2. A fusible link according to claim 1, wherein a plurality of ribs are formed integrally with each of said housings so that said ribs project from an outer surface of said housing at opposite sides of said terminal portions respectively.

3. A fusible link according to claim 1, wherein a retaining portion is formed on one of said housings, while an engagement portion for being engaged with said retaining portion to hold said housings in parallel so as to oppose to each other is formed on another housing.

4. A method of producing a fusible link in which a large current fuse circuit is formed, the fusible link including a plurality of fuse circuit-forming members each having a plurality of terminal portions which are connected to an interconnecting plate portion through respective fusible portions, said plurality of fuse circuit-forming members being mounted on respective insulating housings, the method comprising the steps of:

forming a bus bar having the plurality of fuse circuit-forming members and a bending portion integrally formed between adjacent fuse circuit-forming members of said plurality of fuse circuit-forming members by pressing a single conductive flat plate;

integrating insulating housings with said fuse circuit-forming members by insert molding;

provided respectively at the opposite sides of said bending portion of said bus bar;

bending said bending portion at a predetermined portion so that said housings are opposed in parallel with each other; and engaging a retaining portion formed in one of said two housings with an engagement portion formed in another housing.

* * * * *